US005171138A

United States Patent [19]

Forrest

[11] Patent Number: 5,171,138

[45] Date of Patent: Dec. 15, 1992

[54] COMPOSITE STATOR CONSTRUCTION FOR DOWNHOLE DRILLING MOTORS

[75] Inventor: John Forrest, Houston, Tex.

[73] Assignee: Drilex Systems, Inc., Houston, Tex.

[21] Appl. No.: 845,545

[22] Filed: Mar. 4, 1992

Related U.S. Application Data

[63] Continuation of Ser. No. 632,247, Dec. 20, 1990, abandoned.

[51] Int. Cl.[5] ..... F01C 1/10; F01C 5/02; F01C 5/04; F03C 2/08

[52] U.S. Cl. ..... 418/48; 418/83; 418/153; 418/178

[58] Field of Search ..... 418/48, 83, 153, 178

[56] References Cited

U.S. PATENT DOCUMENTS

| | | | |
|---|---|---|---|
| Re. 21,374 | 2/1940 | Moineau | 418/48 |
| 2,527,673 | 10/1950 | Byram | 418/48 |
| 3,084,631 | 4/1963 | Bourke | 418/48 |
| 3,139,035 | 6/1964 | O'Connor | 418/48 |
| 3,499,389 | 3/1970 | Seeberger et al. | 418/48 |
| 3,822,972 | 7/1974 | Ogly et al. | 418/48 |
| 3,857,654 | 12/1974 | Streicher | 418/48 |
| 3,975,120 | 8/1976 | Tschirky | 418/48 |
| 3,975,121 | 8/1976 | Tschirky | 418/48 |
| 4,144,001 | 3/1979 | Streicher | 418/48 |
| 4,265,323 | 5/1981 | Juergens | 418/48 |
| 4,558,991 | 12/1985 | Barr | 418/48 |
| 4,614,232 | 9/1986 | Jurgens et al. | 418/48 |
| 4,676,725 | 6/1987 | Eppink | 418/48 |
| 4,718,824 | 1/1988 | Cholet et al. | 418/48 |

FOREIGN PATENT DOCUMENTS

| | | | |
|---|---|---|---|
| 2713468 | 9/1978 | Fed. Rep. of Germany | 418/48 |
| 2081812 | 2/1982 | United Kingdom | 418/153 |

*Primary Examiner*—John J. Vrablik

*Attorney, Agent, or Firm*—Edgar A. Zarins; Malcolm L. Sutherland

[57] ABSTRACT

A composite stator construction for a downhole drilling motor which provides improved sealing and distortion properties. The elastomer which maintains the sealing-/pumping action of the motor is applied in a uniform thickness to a rigid metallic form. In the stator, the rigid former has the basic configuration of the stator and is mounted within the casing of the motor. In the rotor, the elastomer can be applied directly to a metallic rotor core. The basic geometry is provided by the metallic former thereby reduces distortion of the lobes under increased torsional forces.

10 Claims, 4 Drawing Sheets

COMPOSITE STATOR CONSTRUCTION FOR DOWNHOLE DRILLING MOTORS

This is a continuation of copending application(s) Ser. No. 07/632,247 filed on Dec. 20, 1990, now abandoned.

BACKGROUND OF THE INVENTION

I. Field of the Invention

This invention relates to drilling motors for downhole applications and, in particular, to a composite stator construction for the drilling motor which improves the pumping capabilities of the motor by providing an elastomer coating over a rigid stator former. Alternatively, the elastomeric coating may be applied to the rotor.

II. Description of the Prior Art

Downhole drilling motors provide direct bit drive in directional drilling or deep drilling by pumping drilling fluid through the motor. The working portion of the motor comprises an outer casing having a multi-lobed stator mounted therein and a multi-lobed rotor disposed within the stator. Typically, the rotor has one less lobe than the stator to facilitate pumping rotation. The rotor and stator interengage at surfaces shaped in the form of helical lobes to form a sealing surface which is acted upon by the drilling fluid to drive the rotor within the stator. In the prior systems, one or the other of the stator/rotor is made of an elastomeric material to maintain a seal therebetween.

In the present design of stators, the elastomer is continuous from the interior helical surface to the outer cylindrical surface which is bonded to the outer casing of the motor. Because of variations in the thickness of the elastomer material of the prior known stators, selection of the elastomer's physical properties necessitates a compromise between a high modulus value to preserve the shape of the lobes under operating stresses and the need to affect a satisfactory seal between the inner surface of the stator and the outer surface of the rotor. As the rotor rotates and precesses within the stator, a seal is formed at each point of contact. However, it is difficult to produce satisfactory elastomer moldings which are rigid enough to prevent distortion of the stator surface. In the event the bit torque exceeds the hydraulic torque developed by the motor while the drill string is rotated, the stator will overrun the rotor damaging the elastomer. Furthermore, a variable thickness elastomer generates heat in the core which leads to premature deterioration in the material properties.

SUMMARY OF THE PRESENT INVENTION

The present invention overcome the disadvantages of the prior known drilling motors by incorporating a rigid stator former to which a uniform thickness of elastomer material is molded thereby improving the sealing properties of the components while also stiffening the stator for transmission of increased torsional forces.

The drilling motor of the present invention incorporates an elastomer material of nominally uniform thickness molded to one of either the stator or rotor of the motor. In this manner, the elastomer is backed by a rigid surface to prevent distortion and degradation which maximizes operating performance. In a preferred embodiment, a metallic stator former is incorporated into the motor casing to increase the amount of torsional force to be transmitted without shearing of the elastomer or a severe distortion of the geometry of the stator.

The elastomer is molded directly to the stator former in a uniform thickness. The thickness of the elastomer may be varied depending upon the application. Additionally, the space between the stator former and the outer casing may be filled with an additional elastomer or resin for support.

In the case of the rotor, the elastomer again is molded to the rotor surface in an approximately uniform thickness which would cooperate with a metallic stator. As with the stator, the elastomer would be supported by the formed lobes of the metallic rotor core for improved operation. The elastomer may be molded or extruded over the rotor. It is also contemplated that older rotors may be repaired by applying a thin layer of elastomer thereby eliminating any non-conformities.

In an alternative embodiment, the elastomer coated rotor or stator may be used in a pump for delivering fluids such as a sump pump. The rotor would be mechanically driven within the stator to pump the fluid through the chamber. Again, the elastomer coating on either the rotor or stator would improve sealing contact while the rigid backing provided to the elastomer improves the shear strength of the lobes.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
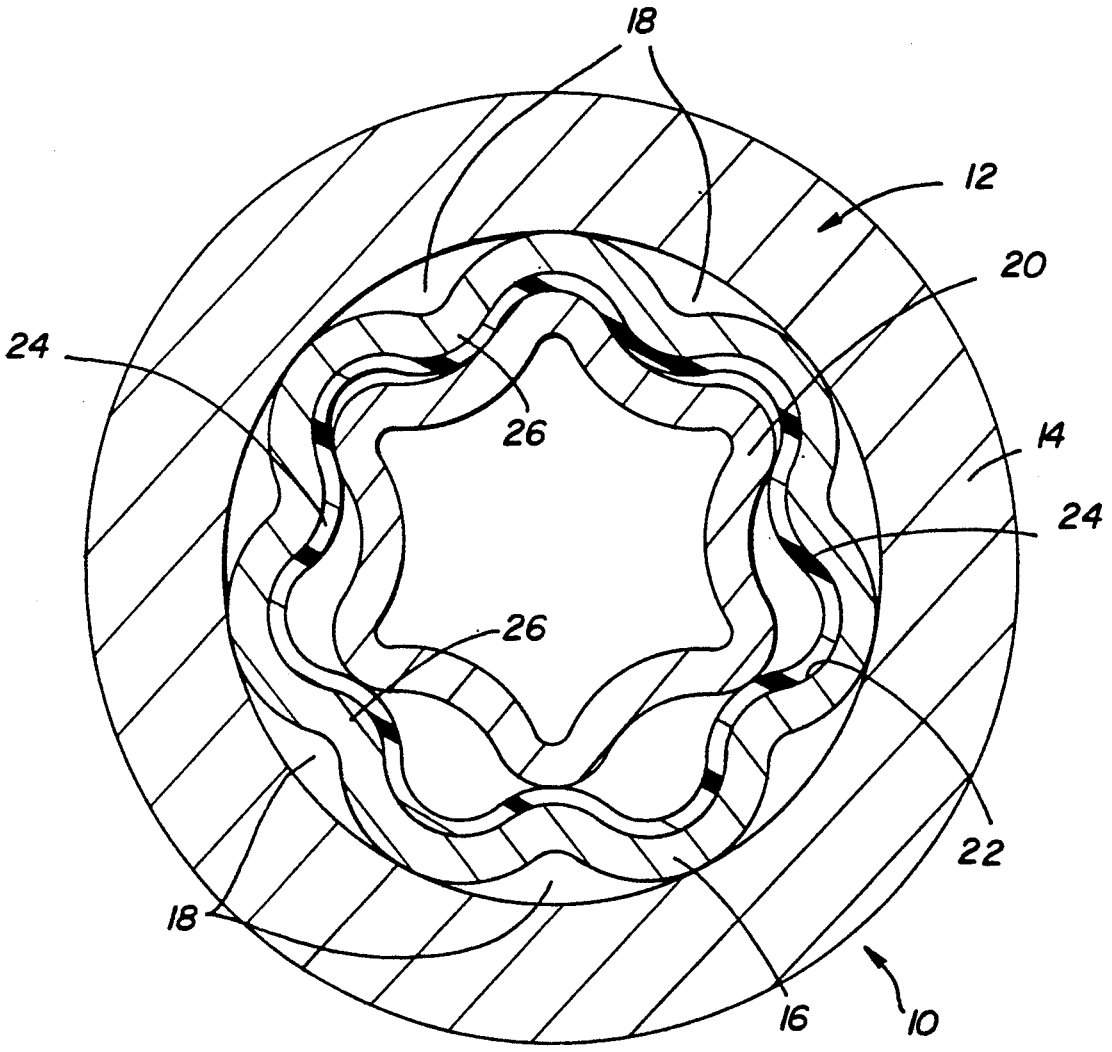
FIG. 1 is a transverse cross-sectional view of a drilling motor incorporating the composite stator construction of the present invention.

Referring to FIG. 1 of the drawing, there is shown a lateral cross-section of the drive section 12 of a downhole drilling motor 10. In a preferred embodiment of the invention, the motor 10 is a multi-lobed assembly used to drive drilling tools 11 and the like by pumping drilling fluid through the drive section 12 of the motor 10. Such downhole drilling motors 10 are typically utilized to provide direct drive of drilling tools 11 in directional and horizontal drilling operations. The downhole positive displacement motor 10 of the present invention is capable of generating high torque at low rotary speeds without distortion of the geometry of the stator/rotor drive 12. As is typical of such motors 10, the stator/rotor drive 12 converts the fluid energy of the drilling fluid in a rotational and precessional motion to turn the drill bit 11.

Figure 4:
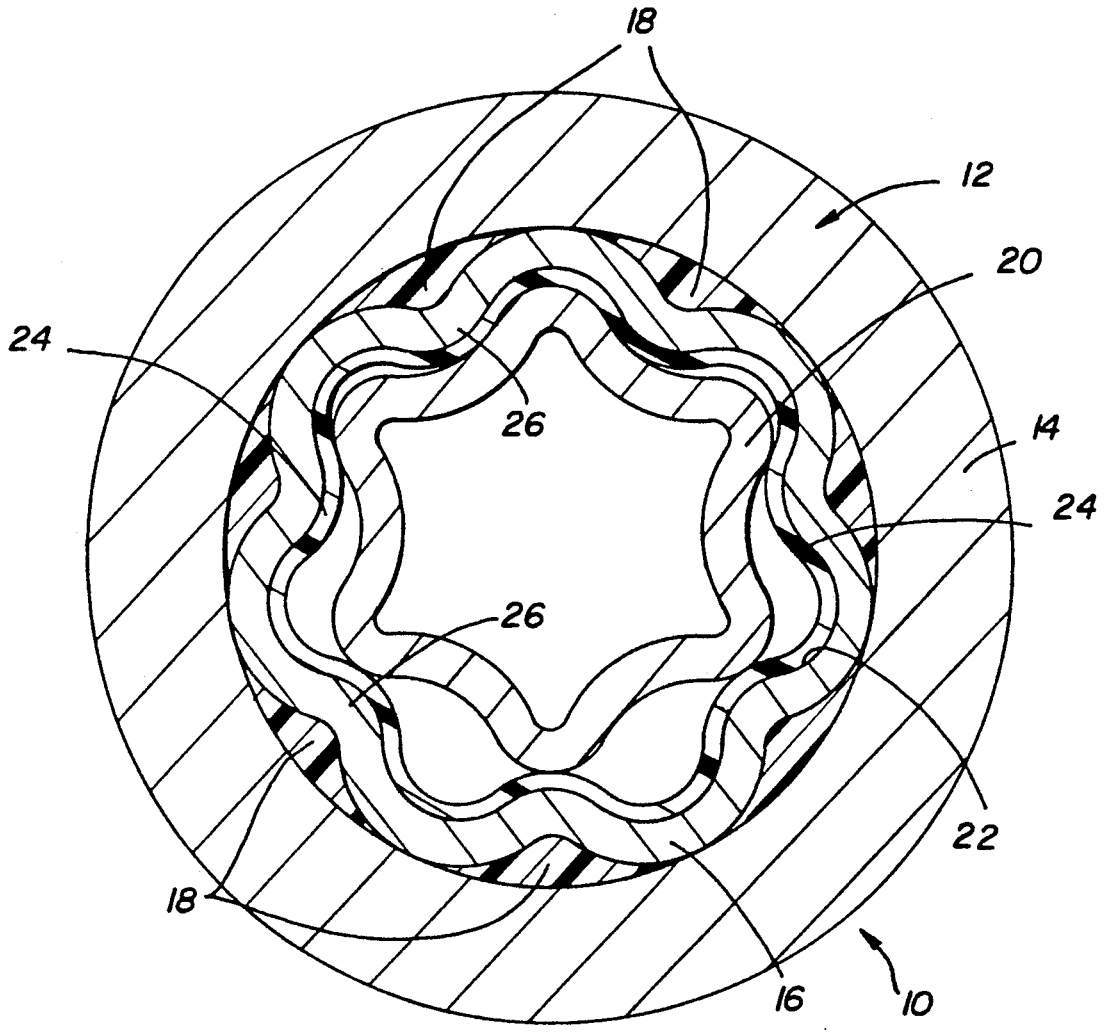
FIG. 4 is a transverse cross-sectional view of a still further embodiment of a drilling motor incorporating the composite stator construction of the present invention.

The drive section 12 of the motor 10 includes an outer casing 14 within which is disposed a rigid stator former 16. The stator former 16 has a helical, multi-lobed configuration. Unlike the prior known stator constructions which are formed entirely of an elastomer, the stator former 16 of the present invention is formed of a rigid material, such as metal, for improved strength. The rigid stator former 16 has a uniform thickness creating helical spaces 18 between the housing casing 14 and the stator former !6. In one embodiment of the present invention, the helical spaces 18 may be filled with an elastomer 19 or other resin to provide added support to the stator former 16 as shown in FIG. 4. The stator former 16 is secured within the housing 14 such that the drilling fluid will flow through the stator former 16.

A multi-lobed helical rotor 20 is disposed within the stator former 16 for rotation therein as drilling fluid is pumped through the stator former 16 to drive the drill bit. The rotor 20 has one fewer lobe than the stator former 16 to allow rotation and precession of the rotor 20 within the motor 10. As with the stator former 16, the rotor 20 is machined from metal with the multi-lobed helical configuration.

In order to form the necessary seal between the stator and rotor to create the flow chambers through which the drilling fluid is pumped thereby driving the rotor 20, either the stator former 16 or the rotor 20 must include an elastomer layer to provide sealing interengagement. In a first embodiment, an inner surface 22 of the stator former 16 is supplied with an elastomeric material 24 of nominally uniform thickness which sealingly engages the rotor 20 as it rotates therein. Unlike the elastomer stators of the prior art wherein the thickness of the elastomer varies in accordance with the geometry of the stator, the uniform thickness of the elastomeric layer 24 supported by the metallic stator former 16 provides greater heat dissipation. The stator former 16 also supports the elastomeric layer 24 allowing the use of a softer elastomer for improved sealing with the rotor 20. However, the rigidity of the stator former 16 maintains the shape of the stator lobes allowing a greater amount of torsional force to be transmitted without shearing of the lobes 26 or severe distortion of the inner geometry. Accordingly, the composite stator cannot deflect enough to allow the rotor 20 to overrun the lobes 26 in the event bit torque exceeds the hydraulic torque developed by the motor 10 while the drill string is rotated.

Figure 2:
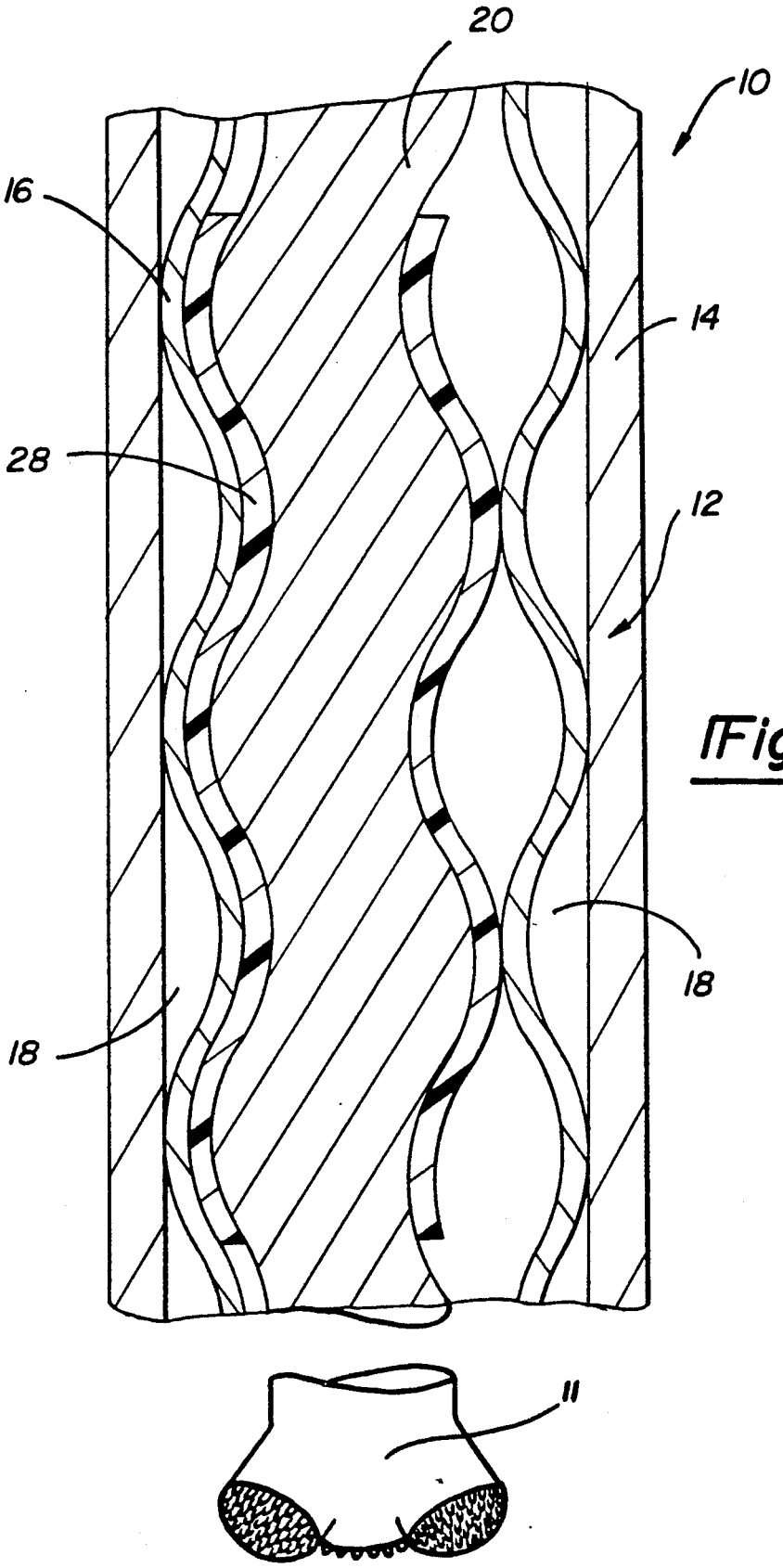
FIG. 2 is a longitudinal cross-sectional view of an alternative embodiment of the drilling motor showing an elastomer coated rotor.
Figure 3:
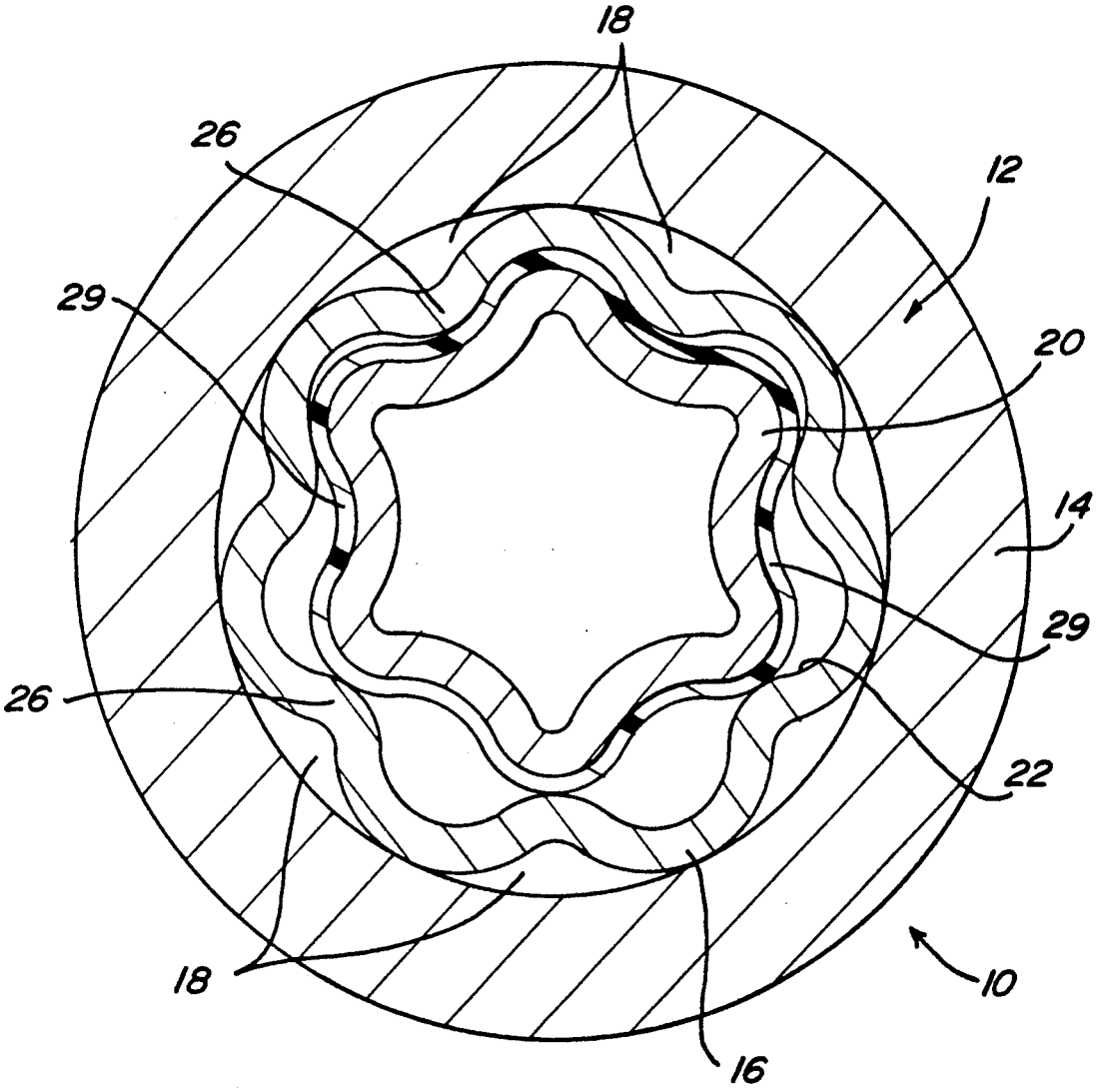
FIG. 3 is a transverse cross-sectional view of an alternate embodiment of a drilling motor incorporating the composite stator construction of the present invention.

In an alternative embodiment, instead of applying the elastomeric material to the stator former 16, the elastomer layer 29 is applied to the outer helical surface 28 of the rotor 20 as shown in FIG. 2. Again, sealing engagement between the rotor 20 and stator 16 is formed as the rotor 20 rotates within the motor 10. The lobed geometry of the rotor 20 provides support for the elastomer preventing distortion. The application of the elastomer over the rotor 20 can be utilized to refurbish worn or damaged rotors by applying a thin uniform layer of elastomer.

It is contemplated that the elastomer can be applied to either the rotor 20 or the stator former 16 in any number of ways including extruding the elastomer directly onto the metallic surface or forming an elastomer sleeve which is bonded to the particular surface. Additional methods of application may be appropriate for providing an elastomer of uniform thickness.

It is contemplated in accordance with the present invention that the composite rotor or stator construction could be used in drilling motors and pumps for delivering fluids. In a pump either the stator or the rotor could be the driven member to create the fluid pumping chamber. The elastomer applied to the rigid stator former or rotor provides improved sealing and pumping action while the rigidness of the components allows higher torques for increased fluid delivery.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a downhole drilling motor for driving drilling tools of the type comprising a housing having an inlet end and an outlet end through which drilling fluid is pumped for activation of said drilling motor, a rigid stator former having a multi-lobed helical configuration including a multi-lobed helical inner surface, said stator former having a uniform thickness wall secured within said housing such that drilling fluid is pumped through said stator former, and a helical multi-lobed rotor disposed in said stator former for rotation therein, said rotor having an outer helical surface, the improvement comprising:

an elastomeric material applied to one of said helical inner surface of said stator former and said helical outer surface of said rotor such that a supported sealing engagement is formed between said elastomeric surface and the other of said stator former and said rotor creating at least one fluid space through which drilling fluid is pumped to rotatively drive said rotor within said housing thereby driving said drill tool, said elastomeric material having a substantially uniform thickness to form a helical sealing surface, said elastomeric material being supported by the underlying lobed structure for improved sealing rigidity of said multiple lobes, said stator former forming a plurality of helical spaces between said housing and said stator former, said helical spaces filled with an elastomeric resin to provide added support to said stator former.

2. The drilling motor as defined in claim 1 wherein said elastomeric material forms a helical sleeve bonded to one of said helical inner surface of said stator former and said helical outer surface of said rotor.

3. A downhole drilling motor for driving drilling tools, said drilling motor comprising:

a cylindrical housing having an inlet end and an outlet end through which drilling fluid is pumped for actuation of said drilling motor;

a rigid stator former formed of a wall of uniform thickness and having a multi-lobed helical configuration including a helical inner surface, said stator former secured within said housing wherein drilling fluid is pumped through said stator former, a plurality of helical spaces formed between said cylindrical housing and said stator former, said plurality of helical spaces filled with an elastomeric material for support of said stator former; and a rotor having a multi-lobed helical outer surface disposed in said stator former for rotation therein as drilling fluid flows through said housing driving said drilling tool;

one of said helical inner surface of said stator former and said helical outer surface of said rotor having a uniform thickness of elastomeric material applied thereto for sealing engagement of the other of said helical inner surface of said stator former and said helical outer surface of said rotor, said elastomeric material structurally supported for improved sealing engagement and shear resistance, said sealing engagement forming at least one fluid space through which drilling fluid is pumped to rotatively drive said rotor within said stator former thereby driving said drilling tool.

4. The drilling motor as defined in claim 3 wherein said elastomeric material forms a helical sleeve bonded to one of said helical inner surface of said stator former and said helical outer surface of said rotor.

5. The drilling motor as defined in claim 3 wherein said elastomeric material is extruded over one of said helical inner surface of said stator former and said helical outer surface of said rotor.

6. A downhole drilling motor for driving drilling tools, said drilling motor comprising:

a cylindrical housing having an inlet end and an outlet end through which drilling fluid is pumped for activation of said drilling motor;

a composite stator disposed within said housing having an inlet and an outlet communicating with said inlet and outlet ends of said housing, said stator including a rigid stator former having wall of uniform thickness and a multi-lobed configuration and an elastomeric material applied to an inner surface of said helical wall of said stator former to form an inner sealing surface for said composite stator, said stator former providing rigid support for said elastomeric sealing surface of said composite stator; and a multi-lobed helical rotor disposed in said composite stator for rotation therein, said rotor sealingly engaging said elastomeric surface of said composite stator to form at least one fluid space through which drilling fluid is pumped to rotatively drive said rotor within said composite stator thereby driving said drilling tool;

a plurality of helical spaces being formed between said cylindrical housing and said wall of said composite stator, said helical spaces extending between said inlet and outlet ends of said composite stator whereby said stator former rigidly supports said elastomeric sealing surface while transferring heat from said composite stator, said helical spaces filled with an elastomer material to provide added support to said composite stator.

7. The drilling motor as defined in claim 6 wherein said elastomeric material is applied to said inner surface of said stator former in a uniform thickness along said inner surface, said stator former providing rigid support of said elastomeric layer.

8. The drilling motor as defined in claim 7 wherein said uniform elastomeric layer is formed as a helical sleeve mounted to said inner surface of said stator former.

9. The drilling motor as defined in claim 7 wherein said uniform elastomeric layer is extruded over said inner surface of said stator former.

10. A downhole drilling motor for driving drilling tools, said drilling motor comprising:

a housing having an inlet end and an outlet end through which drilling fluid is pumped for activation of said drilling motor;

a rigid stator former having a helical configuration including a helical inner surface, said stator former secured within said housing wherein drilling fluid is pumped through said stator former, a plurality of helical spaces being formed between stator former and said housing, said helical spaces filled with an elastomer for support of said stator former; and a rotor having a helical outer surface disposed in said stator former for rotation therein as drilling fluid flows through said housing driving said drilling tool;

one of said helical inner surface of said stator former and said helical outer surface of said rotor having a uniform thickness of elastomeric material applied thereto for sealing engagement of the other of said helical inner surface of said stator former and said helical outer surface of said rotor, said sealing engagement forming at least one fluid space through which drilling fluid is pumped to rotatively drive said rotor within said stator former thereby driving said drilling tool.

* * * * *